US005252035A

United States Patent [19]

Lee

[11] Patent Number: 5,252,035

[45] Date of Patent: Oct. 12, 1993

[54] SUCTION STRUCTURE FOR ELECTRICALLY-DRIVEN HERMETIC COMPRESSOR

[75] Inventor: In S. Lee, Kyungki, Rep. of Korea

[73] Assignee: Goldstar Co., Ltd., Rep. of Korea

[21] Appl. No.: 992,144

[22] Filed: Dec. 17, 1992

[30] Foreign Application Priority Data

Dec. 28, 1991 [KR] Rep. of Korea ..... 24609/1991

[51] Int. Cl.[5] ..... F04B 39/00

[52] U.S. Cl. ..... 417/312; 181/403

[58] Field of Search ..... 417/312, 902; 181/403, 181/269

[56] References Cited

U.S. PATENT DOCUMENTS

| | | | |
|---|---|---|---|
| 4,370,104 | 1/1983 | Nelson | 417/902 |
| 4,531,894 | 7/1985 | Kawai | 417/312 |
| 4,658,778 | 7/1987 | Gamoh | 417/312 |
| 4,730,695 | 3/1988 | Bar | 417/312 |
| 4,793,775 | 12/1988 | Peruzzi | 417/312 |
| 4,990,067 | 2/1991 | Sasano | 417/312 |

*Primary Examiner*—Richard A. Bertsch

*Assistant Examiner*—Peter Korytnyk

*Attorney, Agent, or Firm*—Ostrolenk, Faber, Gerb & Soffen

[57] ABSTRACT

A suction structure for electrically-driven hermetic compressor. The compressor comprises a suction muffler having an upper outlet and a lower inlet which is formed at its bottom with means for discharging refrigerating oil, first elastic means for adsorbing vibration occurring during operation of compressor and guiding suction gas into the suction muffler which is fitted in the lower inlet of the suction muffler, second elastic means for fixing the first elastic means to the inlet of the suction muffler which is interposed between the inlet and the first elastic means without a gap therebetween, and filtering means for preventing refrigerating oil from being introduced into a cylinder which is disposed to the inlet of the suction muffler. Therefore, the suction structure can prevent refrigerating oil from being introduced in the cylinder and also prevent damage and generation of the inlet of the suction muffler due to interference therebetween is prevented, thereby improving performance of compressor.

4 Claims, 2 Drawing Sheets

SUCTION STRUCTURE FOR ELECTRICALLY-DRIVEN HERMETIC COMPRESSOR

BACKGROUND OF THE INVENTION

1. Field of the Invention

The present invention is related to an electrically-driven hermetic compressor, and more particularly to a suction structure for electrically-driven hermetic compressor which includes a filtering member mounted in an outlet of a suction muffler made of plastic material and an elastic material fitted in an inlet of the suction muffler without a gap therebetween.

2. Description of the Prior Art

In a general electrically-driven hermetic compressor, high temperature heat of refrigerant gas discharged from a discharge muffler is transmitted to a suction muffler. Therefore, the transmitted heat causes temperature of refrigerant gas sucked in the suction muffler to rise thereby reducing coefficient of performance of compressor.

In order to overcome the above problem, there has been continuously studied to mold insulating plastic material, such as polyester resin into a suction muffler. For example, a hermetic refrigeration compressor using this type of plastic suction muffler is disclosed in U.S. Pat. No. 4,370,104.

Referring to FIGS. 1A and 1B, there are shown a conventional electrically-driven hermetic compressor using a plastic suction muffler. As shown in the drawing, the compressor comprises an outer shell 1, a compressor section "A" and a motor "B".

The compressor section "A" includes a cylinder 2, a piston 3, a discharge muffler 4 and a suction muffler 5. The discharge muffler 4 and the suction muffler 5 are spaced from each other at a certain interval and mounted on a cylinder head. As shown FIG. 1B, in the suction muffler 5 is inserted an elastic material 7 fitted in a suction pipe 6 with a certain circumferential gap therebetween.

The motor "B" includes a stator 8 and a rotator 9. A crank shaft 10 is fitted in the rotator 9 and thus rotated by rotation of the rotator 9. A crank pin 10*a* is eccentrically fixed to a head of the crank shaft 10 relative to the center of crank shaft 10 and thus eccentrically rotated by the rotation of crank shaft 10. A connecting rod 11 is connected between the crank pin 10*a* and the piston 10 to reciprocate the piston as result of the eccentric rotation of the crank pin 10*a*. The outer shell 1 contains refrigeration oil 12 at its lower part.

In operation of the above mentioned hermetic compressor, as the rotator 9 of the motor "B" is rotated due to supply of electric current, the crank pin 10*a* fixed to the crank shaft 10 is eccentrically rotated. The rotating force of crank shaft 10 is transmitted to the piston 3 through the crank pin 10*a*, thereby causing the piston 3 to be reciprocated in the cylinder 2.

As the piston 3 is reciprocated in the cylinder 2, refrigerant in the cylinder 2 is compressed and continuously sucked in and discharged from the cylinder 2. As a result, refrigerant and refrigerating oil is introduced into the plastic suction muffler 5 through the elastic material 7 and then sucked in the cylinder 2.

In the above hermetic compressor, since a gap of about 2–3 mm is maintained between the elastic material 7 and the suction muffler 5, refrigerant and refrigerating oil are sucked in the suction muffler 5 together and then the refrigerating oil drops into interior of the outer shell 1 through the gap and is collected in the outer shell 1.

However, since the conventional electrically-driven hermetic compressor vibrates upward and downward during operation, interference occurs due to the gap between the plastic suction muffler and the elastic material and thus the plastic suction muffler is damaged or generates its plastic chips due to the interference. Also, since some of refrigerating oil contained in suction gas is introduced into the cylinder and circulated together with refrigerant, performance of the compressor is reduced.

SUMMARY OF THE INVENTION

The present invention has been made in view of the above-described problems occurring in the prior art and an object of the invention is to provide a suction structure for electrically-driven hermetic compressor wherein a suction muffler includes a filtering member fitted at its upper outlet in order to prevent refrigerating oil from being sucked in a cylinder.

Another object of the invention is to provide a suction structure for electrically-driven hermetic compressor wherein a packing is fitted between an inlet of suction muffler and an elastic material in order to prevent the suction muffler from being damaged or plastic chips of the inlet from being generated.

In accordance with the present invention, the object mentioned above can be accomplished by providing a suction structure for electrically-driven hermetic compressor comprising: a suction muffler having an upper outlet and a lower inlet which is formed at its bottom with means for discharging refrigerating oil; first elastic means for adsorbing vibration occurring during operation of compressor and guiding suction gas into the suction muffler which is fitted in the lower inlet of the suction muffler; second elastic means for fixing the first elastic means to the inlet of the suction muffler which is interposed between the inlet and the first elastic means without a gap therebetween; and filtering means for preventing refrigerating oil from being introduced into a cylinder which is disposed to the inlet of the suction muffler.

BRIEF DESCRIPTION OF THE DRAWINGS

These and other objects, features and advantages of the invention will become more apparent upon a reading of the following detailed specification and drawings, in which.

DETAILED DESCRIPTION OF THE PREFERRED EMBODIMENTS

Figure 1A:
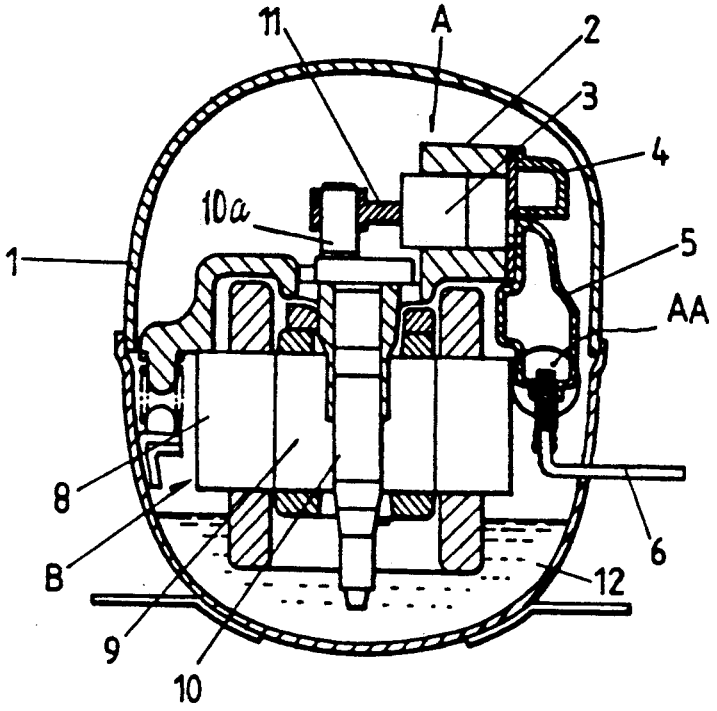
FIG.1A PRIOR ART
FIG. 1A is a sectional view of a conventional electrically-driven hermetic compressor.

A suction structure for electrically-driven hermetic compressor according to the present invention will now be described by referring to FIG. 2. In the drawing, the same reference numerals as those in the description for the known compressor of FIGS. 1A and 1B will denote elements of the invention according to those of the prior art.

Figure 1B:
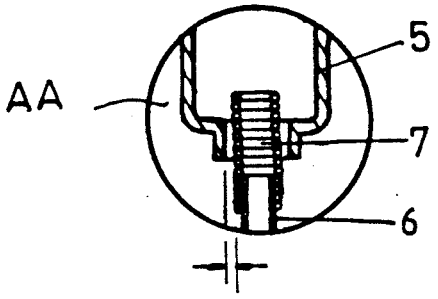
FIG.1B PRIOR ART
FIG. 1B is an enlarged sectional view of the AA part of FIG. 1A.

An electrically-driven hermetic compressor according to the invention comprises an outer shell 1, a compressor section "A" and a motor "B" similarly to the compressor shown in FIG. 1A. The compressor section "A" includes a cylinder 2, a piston 3, a discharge muffler 4 and a suction muffler 20. An elastic material 7 is disposed between an inlet 26 of the suction muffler 20 and a suction pipe 6 to form a suction section "C". The elastic material 7 is adapted to absorb vibration occurring during operation.

Figure 2:
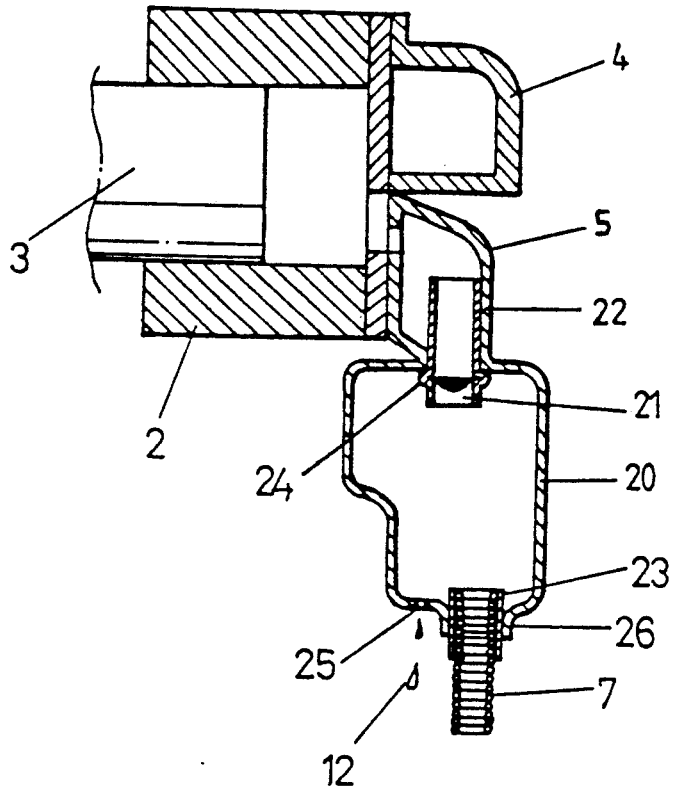
FIG. 2 is a sectional view of a suction structure for electrically-driven compressor according to the present invention.

In the embodiment according to the invention shown in FIG. 2, although the elastic material 7 comprises a coil spring, the elastic material may comprise a bellows pipe or another type elastic material.

As shown again in FIG. 1A, the crank shaft 10 is rotated by rotation of the motor "B" so that the crank pin 10*a* fixed to the head of crank shaft 10 is eccentrically rotated. Therefore, the connecting rod 11 connected to the crank pin 10*a* converts the rotational movement of the crank shaft 10 into reciprocating movement and then transmits it to the piston 3, thereby causing the piston 3 to be reciprocated.

As shown in FIG. 2, a connection pipe 22 is mounted in the bent outlet 25 of the suction muffler 20 and has at its lower end a metallic net 21 for filtering the refrigerating oil 12. The connection pipe 22 is formed with at its lower end an annular projection 24 so that the connection pipe 22 can be retained at the outlet and also the metallic net 21 can be retained in the inner groove of the annular projection 24. The elastic material 7 is inserted in an inlet 26 of the suction muffler 20 with a rubber packing 23 interposed therebetween. The suction muffler 20 is formed with a through hole 25 at a side of the inlet 26 so that refrigerating oil 12 in the suction muffler 20 is discharged through the through hole 25.

In the embodiment shown in FIG. 2, the metallic net 21 is used as a filtering member but a plastic net or another type filtering member may also used.

The operation of the suction structure for electrically-driven hermetic compressor according to this invention will be described as follows.

As shown again in FIG. 1A, as the rotator 9 of the motor "B" is rotated due to supply of electric current, the crank pin 10*a* of the crank shaft 10 is eccentrically rotated. Then, the rotational movement of the crank shaft 10 is transmitted to the piston 3 via the connecting rod 11. Therefore, the piston 3 is reciprocated in the cylinder 2 so that refrigerant and refrigerating oil 12 is introduced into the suction muffler 20 via the suction pipe 6 and the elastic material 7 and then sucked into the cylinder 2.

However, in the embodiment of the invention, refrigerant and refrigerating oil 12 introduced in the suction muffler 20 is filtered through the metallic net 21 fixed to the outlet of the suction muffler 20 so that the refrigerant can pass through the metallic net 21 but the refrigerating oil 12 is intercepted by the metallic net 21. Accordingly, the intercepted refrigerating oil 12 is discharged through the through hole 25 of the suction muffler 20 and then collected in the outer shell 1.

In addition, since the rubber packing 23 is interposed between the inlet 26 of the suction muffler 20 and the elastic material 20 such that a gap can not be presented therebetween, interference can not be generated between the plastic suction muffler 20 and the elastic material 7 even if the compressor vibrates severely, thereby preventing damage of the inlet 26 of the suction muffler 20 and generation of plastic chips of the muffler.

As described in detail above, since the suction muffler of the invention has a metallic net at its outlet, it is possible to prevent refrigerating oil from being introduced in the cylinder. Also, since the rubber packing is interposed between the inlet of the suction muffler and the elastic material without a gap therebetween, damage and generation of the inlet of the suction muffler due to interference therebetween is prevented, thereby improving performance of compressor.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A suction structure for electrically-driven hermetic compressor comprising:

a suction muffler having an upper outlet and a lower inlet;

first elastic means for adsorbing vibration occurring during operation of compressor and guiding suction gas into the suction muffler which is fitted in the lower inlet of the suction muffler;

second elastic means for fixing the first elastic means to the inlet of the suction muffler which is interposed between the inlet and the first elastic means without a gap therebetween; and filtering means for preventing refrigerating oil from being introduced into a cylinder which is disposed to the inlet of the suction muffler.

2. A suction structure for electrically-driven hermetic compressor according to claim 1, wherein said filtering means comprises a net for preventing refrigerating oil contained in suction gas from being sucked into the cylinder and a supporting means for retaining the net in the inlet of the suction muffler.

3. A suction structure for electrially-driven hermetic compressor according to claim 2, wherein said supporting means is formed with means for preventing the supporting means from being separated from the inlet of the suction muffler due to suction gas.

4. A suction structure for electrically-driven hermetic compressor according to claim 1, wherein said suction muffler is formed at its bottom with means for discharging refrigerating oil intercepted by the filtering means.

* * * * *